United States Patent [19]

Yasada

[11] Patent Number: 4,592,476

[45] Date of Patent: Jun. 3, 1986

[54] COMBINATION OF A CONTAINER AND A CLOSURE

[75] Inventor: Seikuro Yasada, Fujisawa, Japan

[73] Assignee: Japan Crown Cork Co., Ltd., Tokyo, Japan

[21] Appl. No.: 721,116

[22] PCT Filed: Jun. 19, 1984

[86] PCT No.: PCT/JP84/00320

§ 371 Date: Mar. 22, 1985

§ 102(e) Date: Mar. 22, 1985

[51] Int. Cl.[4] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 3,650,428 | 3/1972 | Miller | 215/252 |
| 4,394,918 | 7/1983 | Grussen | 215/252 |
| 4,418,828 | 12/1983 | Wilde et al. | 215/252 |
| 4,423,820 | 12/1984 | Vangor | 215/252 |
| 4,488,655 | 12/1984 | Itsubo et al. | 215/252 |
| 4,534,480 | 8/1985 | Santostasi et al. | 215/252 |

*Primary Examiner*—Donald F. Norton

*Attorney, Agent, or Firm*—Beveridge, DeGrandi & Weilacher

[57] ABSTRACT

A container and closure maintain pilferproof characteristics without impairment. The container has a mouth-neck portion having an external thread and an annular anchoring flange located beneath the external thread. The closure is comprised of a cylindrical skirt wall having a circumferentially extending breakable line to divide the skirt wall into a main portion above the breakable line and a pilferproof skirt portion below it. The inner surface of the pilferproof skirt portion has a plurality of circumferentially spaced anchoring flaps extending radially inwardly. A projecting flange projects radially outwardly below the annular anchoring flange. When the closure has been fully mounted on the mouth-neck portion, the lower end of the pilferproof skirt portion contacts or approaches the upper surface of the projecting flange. Furthermore, a plurality of protrusions are spaced circumferentially below the annular anchoring flange on the peripheral surface of the mouth-neck portion. When the closure has been fully mounted on the mouth-neck portion, forward ends of the protrusions contact or approach the inner surface of the pilferproof skirt portion.

13 Claims, 6 Drawing Figures

COMBINATION OF A CONTAINER AND A CLOSURE

FIELD OF TECHNOLOGY

This invention relates to a combination of a container and a closure. More specifically, it relates to a combination of a container and a closure which ensures maintenance of pilferproof characteristics without impairment.

BACKGROUND TECHNOLOGY

As a combination of a container and a closure for foods, drinks, etc. which has pilferproof characteristics, Japanese Laid-Open Patent Publications Nos. 74445/1981 and 30949/1983 disclose a combination of a container equipped with a mouth-neck portion having formed on its periphery an external thread and an annular anchoring flange positioned beneath the external thread with a closure of a unique shape adapted to be mounted on the mouth-neck portion of the container. The closure has a top panel wall and a cylindrical skirt wall extending downwardly from the peripheral edge of the top panel wall. A circumferentially extending breakable line is formed on the skirt wall to divide it into a main portion above the breakable line and a pilferproof skirt portion below it. On the inner circumferential surface of the main portion is formed an internal thread adapted for screwable engagement with the external thread formed on the mouth-neck portion. A plurality of anchoring flaps each extending radially inwardly from its one side edge connected to the inner circumferential surface of the pilferproof skirt portion are formed on the inner circumferential surface of the pilferproof skirt portion in circumferentially spaced-apart relationship. In mounting the closure on the mouth-neck portion, the anchoring flaps elastically bend radially outwardly and thereby pass over the annular anchoring flange. When the closure is fully mounted on the mouth-neck portion, the anchoring flaps which have passed over the annular anchoring flange elastically return to their original state and their upper edges engage the under surface of the annular anchoring flange to thereby hamper the axially upward movement of the pilferproof skirt portion.

The aforesaid container-closure combination has various advantages over combinations of containers and closures having other types of pilferproof characteristics, as can also be understood from the disclosures, etc. of the above-cited Japanese Laid-Open Patent Publication No. 74445/1981. However, the present inventor's experiments have revealed the following problem. In the aforesaid container-closure combination, some gap necessarily exists between the inner circumferential surface of the pilferproof skirt portion of the closure and the peripheral surface of the mouth-neck portion of the container when the closure has been mounted in position on the mouth-neck portion of the container. The present inventor turned his attention to this gap, and advanced a thin elongated metallic strip between the inner circumferential surface of the pilferproof skirt portion and the peripheral surface of the mouth-neck portion through this gap so that the thin metallic strip lay along the entire circumference. It was consequently found that the thin metallic strip acted on the anchoring flaps formed on the inner circumferential surface of the pilferproof skirt portion to elastically bend them radially outwardly and thereby reduce greatly the engagement of the anchoring flaps with the under surface of the annular anchoring flange; and therefore by simply turning the closure in the opening direction, the entire closure could be removed from the mouth-neck portion to open the mouth-neck portion without involving breakage of the breakable line, and thus the pilferproof characteristics could be destroyed.

DISCLOSURE OF THE INVENTION

It is a primary object of this invention is to improve the aforesaid container-closure combination and ensure maintenance of its pilferproof characteristics by making it extremely difficult or impossible to destroy its pilferproof characteristics by, for example, the aforesaid operation involving using a thin metallic strip.

As an improved container-closure combination which achieves the aforesaid object, the present invention provides a combination consisting of a container equipped with a mouth-neck portion having formed on its peripheral surface an external thread and an annular anchoring flange located beneath the external thread and a closure comprised of a top panel wall and a cylindrical skirt wall extending downwardly from the peripheral edge of the top panel wall, said skirt wall having formed therein a circumferentially extending breakable line to divide the skirt wall into a main portion above the breakable line and a pilferproof skirt portion below it, the inner circumferential surface of said main portion having formed therein an internal thread to be screwably engaged with the external thread on the mouth-neck portion, and the inner circumferential surface of said pilferproof skirt portion having formed therein a plurality of circumferentially spaced anchoring flaps each extending radially inwardly from its one side edge connected to the inner circumferential surface of the pilferproof skirt portion, wherein in mounting the closure on the mouth-neck portion, the anchoring flaps pass over the annular anchoring flange by being elastically bent radially outwardly, and when the closure has been fully mounted on the mouth-neck portion, the anchoring flaps which have passed over the annular anchoring flange return elastically and the upper edges of the anchoring flaps engage the under surface of the annular anchoring flange to hamper the axially upward movement of the pilferproof skirt portion; characterized in that a projecting flange projecting radially outwardly at a position spaced downwardly a predetermined distance from the annular anchoring flange is formed on the peripheral surface of the mouth-neck portion and when the closure has been fully mounted on the mouth-neck portion, the lower end of the pilferproof skirt portion contacts or approaches the upper surface of the projecting flange, and/or a plurality of protrusions spaced circumferentially below the annular anchoring flange are formed on the peripheral surface of the mouth-neck portion, and when the closure has been fully mounted on the mouth-neck portion, the forward ends of the protrusions contact or approach the inner circumferential surface of the pilferproof skirt portion.

Other objects of this invention will become apparent from the following detailed description of the embodiments of the invention with reference to the accompanying drawings.

BEST MODE OF PRACTICING THE INVENTION

The invention will be described below in detail with reference to the accompanying drawings showing the embodiments of the container-closure combination improved in accordance with this invention.

Figure 2:
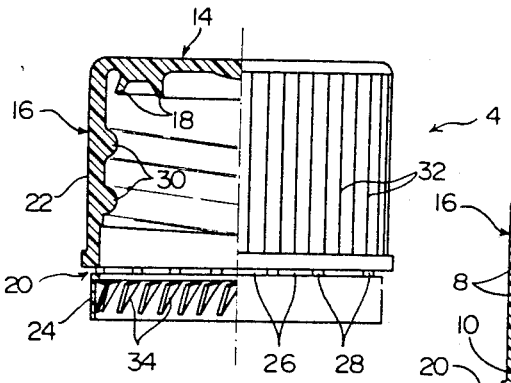
FIG. 2 is a side elevation, partly in section, of a closure in one embodiment of the combination improved in accordance with this invention.
Figure 1:
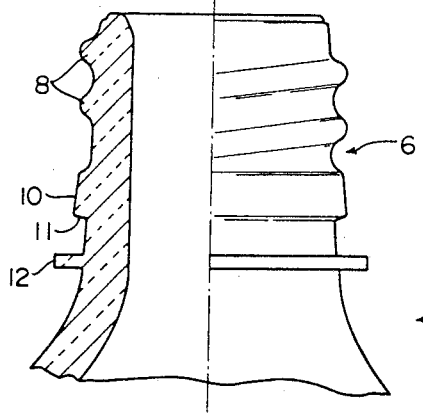
FIG. 1 is a side elevation, partly in section, of the mouth-neck portion of a container in one embodiment of the combination improved in accordance with this invention.

The first embodiment improved in accordance with this invention comprises a combination of the container 2 shown in FIG. 1 and the closure 4 shown in FIG. 2.

With reference to FIG. 1, the container 2 which may be formed of glass or a suitable synthetic resin has a mouth-neck portion 6 at its upper portion. The mouth-neck portion 6 with an open upper end is nearly cylindrical in shape, and on its peripheral surface are formed an external thread 8 and an annular anchoring flange 10 located beneath the external thread 8. The circumferential side surface of the anchoring flange 10 is inclined radially outwardly in the downward direction. An annular anchoring surface 11 which is substantially horizontal or is slightly inclined radially inwardly is defined on the under surface of the anchoring flange 10.

The above structure of the mouth-neck portion 6 of the container 2 is the same as the structures of conventional mouth-neck portions. But on the peripheral surface of the mouth-neck portion 6 of the container 2 in the first embodiment of the combination improved in accordance with this invention, a projecting flange 12 is further formed which projects radially inwardly at a position spaced downwardly a predetermined distance from the anchoring flange 10. Conveniently, the projecting flange 12 is of an annular shape continuous in the circumferential direction. The outside diameter of the projecting flange 12 is equal to, or larger than, the outside diameter of the lower end of the closure 4 to be mounted on the mouth-neck portion 6. As will be described hereinbelow, when the closure 4 has been mounted in position on the mouth-neck portion 6, the lower end of the closure 4 contacts or approaches the upper surface of the projecting flange 12.

Now, with reference to FIG. 2, the closure 4 which may be formed of a suitable synthetic resin such as polyethylene or polypropylene has a circular top panel wall 14 and a nearly cylindrical skirt wall 16 extending downwardly from the peripheral edge of the top panel wall 14. An annular sealing portion 18 of a suitable cross-sectional shape is formed on the inner surface of the top panel wall 14. If desired, a separate sealing member made of a different synthetic resin, etc. may be disposed on the inner surface of the top panel wall 14 instead of forming the annular sealing portion 18 integrally with the inner surface of the top panel wall 14. A circumferentially extending breakable line 20 is formed on the skirt wall 16 to divide the skirt wall 16 into a main portion 22 above the breakable line 20 and a pilferproof skirt portion 24 below it. The breakable line 20 in the illustrated embodiment is composed of a plurality of circumferentially extending and circumferentially spaced slits 26 and a plurality of bridging portions 28 left among these slits 26, and the pilferproof skirt portion 24 is connected to the main portion 22 by the plurality of the bridging portions 28.

An internal thread 30 is formed on the inner circumferential surface of the main portion 22 of the skirt wall 16. On the outer circumferential surface of the main portion 22 is formed a raised and depressed or knurled portion 32 for preventing finger slippage during the turning of the closure 4 by fingers. On the other hand, a plurality of circumferentially spaced anchoring flaps 34 are formed on the inner circumferential surface of the pilferproof skirt portion 24. Conveniently, each of the anchoring flaps 34 extends from its one side edge connected to the inside surface of the pilferproof skirt portion 24 while being inclined radially inwardly in a direction (the counterclockwise direction as viewed from above in FIG. 2) opposite to the turning direction (the clockwise direction as viewed from above in FIG. 2) of the closure 4 in mounting the closure 4 on the mouth-neck portion 4 of the container 2 in the manner to be described hereinbelow. The closure 4 itself described above does not include the novel improvement in the combination improved in accordance with this invention, and may be of the same structure as the closure disclosed in the above-cited Japanese Laid-Open Patent Publication No. 74445/1981 or 30949/1983.

Figure 3:
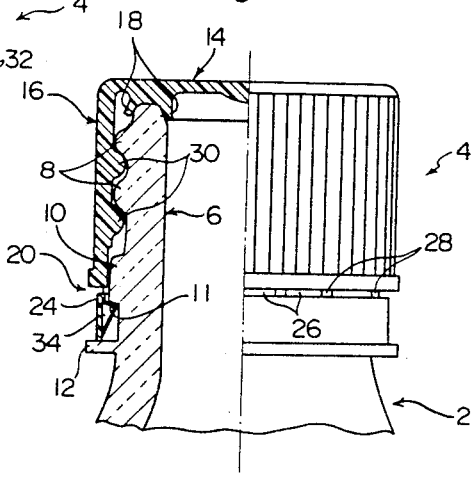
FIG. 3 is a side elevation, partly in section, of the state in which the closure of FIG. 2 has been mounted on the mouth-neck portion of FIG. 1.

With reference to FIG. 3 taken in conjunction with FIGS. 1 and 2, to seal the mouth-neck portion 6 by mounting the closure 4 on it, the closure 4 is put over the mouth-neck portion 6 and turned in the mounting direction, i.e. clockwise as viewed from above in FIG. 3. As a result, the internal thread 30 formed in the closure 4 is screwably engaged with the external thread 8 formed in the mouth-neck portion 6, whereby the closure 4 is moved axially downwardly as it is turned. When the closure 4 is moved downwardly, the anchoring flaps 34 formed in the closure 4 pass over the external thread 8 formed on the mouth-neck portion 6 and further over the anchoring flange 10. At this time, the anchoring flaps 34 bend elastically counterclockwise as viewed from above in FIGS. 2 and 3 under the action of the anchoring flange 10. Thus, with the downward movement of the closure 4, the anchoring flaps 34 can pass over the anchoring flange 10.

When the internal thread 30 of the closure 4 has been fully screwably engaged with the external thread 30 of the mouth-neck portion 6 and as shown in FIG. 3 the closure 4 has been fully mounted on the mouth-neck portion 6, the anchoring flaps 34 completely pass over the anchoring flange 10 and no longer undergo the action of the anchoring flange 10 but return elastically to their original state. As a result, the upper edges of the anchoring flaps 34 are anchored by the annular anchoring surface 11 defined in the under surface of the anchoring flange 10. Furthermore, when the closure 4 is fully mounted on the mouth-neck portion, the annular sealing portion 18 formed on the inner surface of the top panel wall 14 engages the upper edge of the mouth-neck portion 6 to seal the mouth-neck portion 6 accurately, as illustrated in FIG. 3.

In addition, when the closure 4 has been fully mounted on the mouth-neck portion 6 in the above combination improved in accordance with this invention, the lower end of the pilferproof skirt portion 24 of the closure 4 contacts or approaches the upper surface of the projecting flange 12 formed on the mouth-neck portion 6, as shown in FIG. 3. Accordingly, any attempt to advance a thin metal strip or the like from below into the space between the inner circumferential surface of the pilferproof skirt portion 24 and the peripheral surface of the mouth-neck portion 6 fails or encounters extreme difficulty owing to the presence of the projecting flange 12. According to the aforesaid combination improved in accordance with this invention, therefore, it is extremely difficult or impossible to destroy the pilferproof characteristics by using a thin metallic strip, etc., and the maintenance of the pilferproof characteristics can be secured.

To open the mouth-neck portion 6 by removing the closure 4 mounted on the mouth-neck portion 6 from the mouth-neck portion 6, the closure 4 is turned in a direction opposite to the turning direction for mounting, namely in the counterclockwise direction as viewed from above in FIG. 3. As a result, the internal thread 30 formed in the closure 4 is moved along the external thread 8 formed on the mouth-neck portion 6, and therefore, the closure 4 tends to move axially upwardly. However, the axially upward movement of the pilferproof skirt portion 24 of the closure 4 is hampered because the upper edges of the anchoring flaps 34 formed on the inner surface of the pilferproof skirt portion 24 are anchored by the annular anchoring surface 11 defined on the under surface of the anchoring flange 10 of the mouth-neck portion 6. Consequently, a considerable stress is generated on each of the bridging portions 28 of the breakable line 20 formed on the closure 4 to break the bridging portions 28 connecting the pilferproof skirt portion 24 to the main portion 22 of the skirt wall 16. After this, the closure 4 excepting the pilferproof skirt portion 24 can easily move axially upwardly. Hence, as the closure 4 turns, it moves axially upwardly and is removed from the mouth-neck portion 6. Consequently, the mouth-neck portion 6 is opened. On the other hand, the pilferproof skirt portion 24 remains undetached from the mouth-neck portion 6.

The embodiment described above is constructed such that when the mouth-neck portion 6 is opened by removing the closure 4 from the mouth-neck portion 6, the breakable line 20 formed on the skirt wall 16 is completely separated into the main portion 22 and the pilferproof skirt portion 24, and therefore, the top panel wall 14 of the closure 4 and the main portion 22 of the skirt wall 16 are removed from the mouth-neck portion 6 but the pilferproof skirt portion 24 is left at the mouth-neck portion 6. If desired, however, the following construction may be employed as is well known in regard to metallic closures having pilferproof characteristics. Specifically, at least one axially extending breakable line is formed in the pilferproof skirt portion 24, and at least one bridging portion in the circumferentially extending breakable line 20 formed in the skirt wall 16 is rendered tough, so that in opening the mouth-neck portion 6 by removing the closure 4 from the mouth-neck portion 6, the axially extending breakable line formed on the pilferproof skirt portion 24 is broken to open the originally annular pilferproof skirt portion 24 in tape form, whereas the circumferential breakable line 20 formed on the skirt wall 16 is not completely broken and the pilferproof skirt portion 24 of the skirt wall 16 is not completely separated from the main portion 22 but partly remains connected to the main portion 22. Thus, the pilferproof skirt portion 24 is not left on the mouth-neck portion 6, but the entire closure 4 including the pilferproof skirt portion 24 can be removed from the mouth-neck portion 6.

Figure 4:
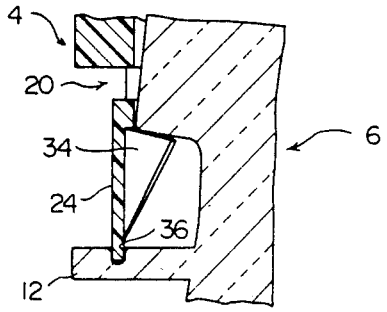
FIG. 4 is a partial sectional view showing a modified embodiment of the combination improved in accordance with this invention when the closure has been mounted on the mouth-neck portion of the container.

FIG. 4 shows a modified embodiment of the combination improved in accordance with this invention. In this modified embodiment, a groove 36 is formed on the upper surface of the projecting flange 12. When the projecting flange 12 is of an annular shape continuous in the circumferential direction, the groove 36 is also of an annular shape continuous in the circumferential direction. When the closure 4 has been fully mounted on the mouth-neck portion 6 in this modified embodiment as shown in FIG. 4, the lower end of the pilferproof skirt portion 24 of the closure 4 is inserted into the groove 36 formed on the upper surface of the projecting flange 12. As a result, destroying of the pilferproof characteristics by using a thin metal strip, etc. can be prevented more accurately.

Figure 5:
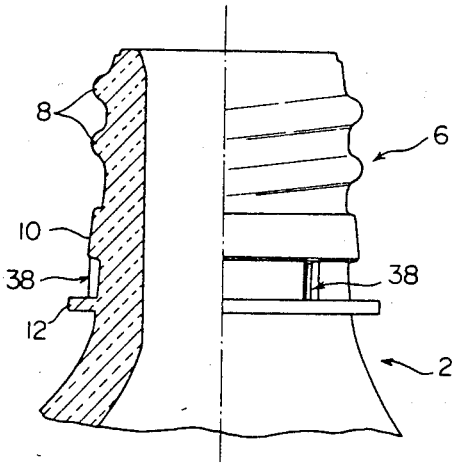
FIG. 5 is a side elevation, partly in section, showing the mouth-neck portion of the container in still another embodiment of the combination improved in accordance with this invention.
Figure 6:
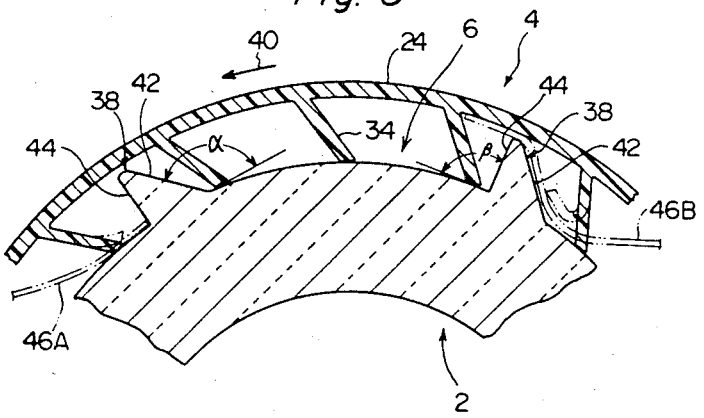
FIG. 6 is a sectional view showing the state in which the closure of FIG. 2 has been mounted on the mouth-neck portion of FIG. 5.

FIGS. 5 and 6 show still another embodiment of the combination improved in accordance with this invention. In this embodiment, in addition to the external thread 8, the annular anchoring flange 10 located beneath the external thread 8 and the projecting flange 12 located beneath the annular anchoring flange 10, a plurality of (for example, about 3 to 10) circumferentially spaced protrusions 38 are formed on the peripheral surface of the mouth-neck portion 6 of the container 2 between the annular anchoring flange 10 and the projecting flange 12. The illustrated protrusions 38 extend axially all the way from the lower surface of the annular anchoring flange 10 to the upper surface of the projecting flange 12. If desired, the protrusions 38 may be provided so as to extend only partly in the axial direction between the lower surface of the annular anchoring flange 10 and the upper surface of the projecting flange 12. The amount of the radial extension of the protrusions 38 may be nearly equal to the amount of the radial extension of the annular anchoring flange 10. Preferably, one of the circumferential side surface of each protrusion 38, i.e. one side surface 42 located on the upstream side as viewed in the turning direction of the closure 4 shown by an arrow 40 in FIG. 6 at the time of mounting the closure 4 on the mouth-neck portion 6 of the container 2, forms an angle $\alpha$ of more than 90°, particularly 110° to 150°, to a tangent to the peripheral surface of the mouth-neck portion 6. On the other hand, it is preferred that the other circumferential side surface of each protrusion 38 located on the downstream side as viewed in the turning direction of the closure 4 shown by arrow 40 in FIG. 6 at the time of mounting the closure 4 on the mouth-neck portion 6 of the container 2 forms an angle $\beta$ of not more than 90°, particularly 50° to 90°, to a tangent to the peripheral surface of the mouth-neck portion 6.

The closure 4 to be mounted on the mouth-neck portion 6 of the container 2 illustrated in FIGS. 5 and 6 may be of the form shown in FIG. 2. As can be easily understood by reference to FIG. 6, in mounting the closure 4 on the mouth-neck portion 6 the protrusions 38 located beneath the anchoring flange 10 interfere with the anchoring flaps 34 formed on the inner circumferential surface of the pilferproof skirt portion 24 of the closure 4. But the anchoring flaps 34 of the closure 4 which is turned in the direction of arrow 40 elastically bend radially outwardly upon contact with one side surfaces 42 of the protrusions 38, and thus can pass circumferentially over the protrusions 38. When the closure 4 has been fully mounted on the mouth-neck portion 6, the forward ends of the protrusions 38 contact or approach the inner circumferential surface of the pilferproof skirt portion 24, as shown in FIG. 6. Even if one or more of the anchoring flaps 34 are positioned in alignment with one or more protrusions 38 and therefore elastically bend radially outwardly when the closure 4 has been fully mounted in position on the mouth-neck portion 6, the other anchoring flaps 34 are deviated circumferentially with respect to the protrusions 38 and return elastically to their original state to accurately engage the annular anchoring surface 11 formed on the under surface of the anchoring flange 10. Accordingly, no particular trouble occurs.

The plurality of protrusions 38 formed on the peripheral surface of the mouth-neck portion 6 prevent the destroying of the pilferproof characteristics more accurately. Even if a foreign object 46A such as a thin metal strip or a metal filament can be inserted between the inner circumferential surface of the pilferproof skirt portion 24 and the peripheral surface of the mouth-neck portion 6, for example in a direction opposite to the direction of arrow 40, as shown by a two-dot chain line in FIG. 6, the forward end of the foreign object **46*a* is biased toward the peripheral surface of the mouth-neck portion 6 by the action of the anchoring strips 34 and contact the side surfaces 44 of the protrusions 38. As a result, the advancing of the foreign object 46A in the opposite direction to the direction of arrow 40 is hampered and it is extremely difficult or impossible for the foreign object 46A to bend at least a considerable number of the anchoring flaps 34 radially outwardly. Even when a foreign object 46B such as a thin metallic strip or a metal filament can be inserted between the inner circumferential surface of the pilferproof skirt portion 24 and the peripheral surface of the mouth-neck portion 6 in the direction of arrow 40, the forward end of the foreign object 46B contacts the anchoring flap 34 inclined in a direction facing it. Even when by bending the anchoring flaps 34 in the state shown by the two-dot chain line and the foreign object 46B can advance past the anchoring flap 34, it contacts one side surface 42 of the protrusion 38. Furthermore, even when the foreign object 46B can advance along the side surface 42 forming an angle of more than 90° to the tangent to the peripheral surface and go past the protrusion 38, it contacts the base portion of the anchoring flap 34 existing next. Thus, the advancing of the foreign object 46B in the direction of arrow 40 can be hampered, and it is extremely difficult or impossible for the foreign object 46B to bend at least a considerable number of the anchoring flaps 34** radially outwardly.

When the plurality of protrusions 38 are formed on the peripheral surface of the mouth-neck portion 6 of the container 2, even if the foreign object 46A or 46B can be inserted between the inner circumferential surface of the pilferproof skirt portion 24 and the peripheral surface of the mouth-neck portion 6, it is extremely difficult or impossible for the foreign object to bend at least a considerable number of the anchoring flaps 34 radially outwardly, as stated above. If desired, therefore, the projecting flange 12 may be omitted in this case. Even then, the pilferproof characteristics are fully accurately retained without destruction.

While some embodiments of the combination improved in accordance with this invention have been described in detail with reference to the accompanying drawings, the invention, of course, is not limited to these embodiments, and various changes and modifications are possible without departing from the invention.

UTILIZABILITY IN INDUSTRY

According to the container-closure combination of this invention, it is extremely difficult or impossible to destroy the pilferproof characteristics, and the pilferproof characteristics can be secured, as stated above in detail. Hence, the container-closure combination of this invention is particularly suitable for holding foods and drinks.

What is claimed is:

1. A combination comprising a container having a mouth-neck portion having formed on its peripheral surface an external thread and an annular anchoring flange located beneath the external thread, and a closure comprised of a top panel wall having a peripheral edge and a cylindrical skirt wall extending downwardly from the peripheral edge of the top panel wall, said skirt wall having formed therein a circumferentially extending breakable line to divide the skirt wall into a main portion above the breakable line and a pilferproof skirt portion below the breakable line, said main portion having an inner circumferential surface and formed in said surface an internal thread to be screwably engaged with the external thread on the mouth-neck portion, wherein said pilferproof skirt portion has an inner circumferential surface and formed in said surface a plurality of circumferentially spaced anchoring flaps, wherein each flap has one side edge connected to the inner circumferential surface of the pilferproof skirt portion and each flap extends radially inwardly from the side edge, wherein in mounting the closure on the mouth-neck portion, the anchoring flaps pass over the annular anchoring flange by being elastically bent radially outwardly, and when the closure has been fully mounted on the mouth-neck portion, the anchoring flaps which have passed over the annular anchoring flange return elastically, wherein each flap has an upper edge and the annular anchoring flange has an under surface and the upper edges of the anchoring flaps engage the under surface of the annular anchoring flange to hamper the axially upward movement of the pilferproof skirt portion;

a projecting flange formed on the peripheral surface of the mouth-neck portion wherein the flange projects radially outwardly at a position spaced downwardly a predetermined distance from the annular anchoring flange, wherein the pilferproof skirt portion has a lower end and the projecting flange has an upper surface with a groove formed thereon, and when the closure has been fully mounted on the mouth-neck portion, the lower end of the pilferproof skirt portion is inserted in the groove on the upper surface of the projecting flange.

2. The combination set forth in claim 1 wherein a plurality of circumferentially spaced protrusions are formed on the peripheral surface of the mouth-neck portion between the annular anchoring flange and the projecting flange, wherein each protrusion has a forward end and when the closure has been fully mounted on the mouth-neck portion, the forward ends of the protrusions at least approach the inner circumferential surface of the pilferproof skirt portion.

3. The combination set forth in claim 2 wherein each of the anchoring flaps extends radially inwardly and inclinedly in a direction opposite to the direction of turning the closure for mounting the closure on the mouth-neck portion, and one side surface of each of said protrusions forms an angle $\alpha$ of more than 90° to a tangent to the peripheral surface of the mouth-neck portion, wherein the angle $\alpha$ is measured from said tangent to said one side surface in a direction opposite to the direction of turning the closure for mounting, and the other side surface of each of said protrusions forms an angle $\beta$ of not more than 90° to a tangent to the peripheral surface of the mouth-neck portion, wherein the angle $\beta$ is measured from said other side surface to said tangent in a direction opposite to the direction of turning the closure for mounting.

4. The combination set forth in claim 3 wherein said angle $\alpha$ is 110° to 150°, and said angle $\beta$ is a 50° to 90°.

5. The combination set forth in claim 4 wherein the forward ends of the protrusions contact the inner circumferential surface of the pilferproof skirt portion.

6. The combination set forth in claim 3 wherein the forward ends of the protrusions contact the inner circumferential surface of the pilferproof skirt portion.

7. The combination set forth in claim 3 wherein said angle $\alpha$ is 110° to 150°, and said angle $\beta$ is 50° to 90°.

8. The combination set forth in claim 7 wherein the forward ends of the protrusions contact the inner circumferential surface of the pilferproof skirt portion.

9. The combination set forth in claim 2 wherein the forward ends of the protrusions contact the inner circumferential surface of the pilferproof skirt portion.

10. A combination comprising a container having a mouth-neck portion having formed on its peripheral surface an external thread and an annular anchoring flange located beneath the external thread, and a closure comprised of a top panel wall having a peripheral edge and a cylindrical skirt wall extending downwardly from the peripheral edge of the top panel wall, said skirt wall having formed therein a circumferentially extending breakable line to divide the skirt wall into a main portion above the breakable line and a pilferproof skirt portion below the breakable line, said main portion having an inner circumferential surface and formed in said surface an internal thread to be screwably engaged with the external thread on the mouth-neck portion, wherein said pilferproof skirt portion has an inner circumferential surface and formed in said surface a plurality of circumferentially spaced anchoring flaps, wherein each flap has one side edge connected to the inner circumferential surface of the pilferproof skirt portion and each flap extends radially inwardly from the side edge, wherein in mounting the closure on the mouth-neck portion, the anchoring flaps pass over the annular anchoring flange by being elastically bent radially outwardly, and when the closure has been fully mounted on the mouth-neck portion, the anchoring flaps which have passed over the annular anchoring flange return elastically, wherein each flap has an upper edge and the annular anchoring flange has an under surface and the upper edges of the anchoring flaps engage the under surface of the annular anchoring flange to hamper the axially upward movement of the pilferproof skirt portion;

a plurality of protrusions formed on the peripheral surface of the mouth-neck portion, wherein the protrusions are spaced circumferentially below the annular anchoring flange, wherein each protrusion has a forward end, and when the closure has been fully mounted on the mouth-neck portion, the forward ends of the protrusions at least approach the inner circumferential surface of the pilferproof skirt portion.

11. The combination set forth in claim 10 wherein each of the anchoring flaps extend radially inwardly and inclinedly in a direction opposite to the direction of turning the closure for mounting the closure on the mouth-neck portion, and one side surface of each of said protrusions forms an angle $\alpha$ of more than 90° to a tangent to the peripheral surface of the mouth-neck portion, wherein the angle $\alpha$ is measured from said tangent to said one side surface in a direction opposite to the direction of turning the closure for mounting, and the other side surface of each of said protrusions forms an angle $\beta$ of not more than 90° to a tangent to the peripheral surface of the mouth-neck portion, wherein the angle $\beta$ is measured from said other side surface to said tangent in a direction opposite to the direction of turning the closure for mounting.

12. The combination set forth in claim 11 wherein the forward ends of the protrusions contact the inner circumferential surface of the pilferproof skirt portion.

13. The combination set forth in claim 10 wherein the forward ends of the protrusions contact the inner circumferential surface of the pilferproof skirt portion.

* * * * *